US006257464B1

(12) United States Patent
Dalton et al.

(10) Patent No.: US 6,257,464 B1
(45) Date of Patent: Jul. 10, 2001

(54) DISPENSING MECHANISM WITH DUAL FUNCTION FLOW REGULATOR AND SEALING PLATE

(75) Inventors: David Andrew Dalton, Loveland, OH (US); Eric Francis Henry, Rutherford, NJ (US); Brian Paul Krieg, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/206,521

(22) Filed: Dec. 7, 1998

(51) Int. Cl.[7] ..... B65D 47/10
(52) U.S. Cl. ..... 222/560
(58) Field of Search ..... 222/560, 185.1

(56) References Cited

U.S. PATENT DOCUMENTS

| | | | | |
|---|---|---|---|---|
| 276,020 | | 10/1984 | Battista | D7/79 |
| 296,405 | | 6/1988 | Weaver | D7/76 |
| 332,374 | | 1/1993 | Saunders | D7/589 |
| 335,242 | | 5/1993 | Saunders | D7/589 |
| 1,667,959 | * | 5/1928 | Talbot et al. | 222/560 |
| 2,718,335 | | 9/1955 | Shippen | 222/135 |
| 2,775,270 | | 12/1956 | McKillop, Jr. | 141/373 |
| 3,204,833 | | 9/1965 | Weitzner | 222/355 |
| 4,113,150 | | 9/1978 | Ostergaard | 222/243 |
| 4,143,432 | | 3/1979 | Deken | 4/295 |
| 4,176,767 | | 12/1979 | Franche, IV | 222/243 |
| 4,241,855 | | 12/1980 | Yoshioka | 222/479 |
| 4,287,921 | | 9/1981 | Sanford | 141/360 |
| 4,384,662 | | 5/1983 | Boudin et al. | 222/484 |
| 4,557,404 | | 12/1985 | Solomon | 222/325 |
| 4,572,376 | | 2/1986 | Wrennall | 206/538 |
| 4,776,493 | | 10/1988 | Tegel | 222/196 |
| 4,854,478 | | 8/1989 | Gyimothy | 221/190 |
| 4,969,586 | | 11/1990 | Ostroski | 222/545 |
| 4,997,112 | | 3/1991 | Eichler | 222/530 |
| 5,105,991 | | 4/1992 | Johnson | 222/185 |
| 5,125,542 | | 6/1992 | Blanc | 222/181 |

(List continued on next page.)

FOREIGN PATENT DOCUMENTS

| | | | | |
|---|---|---|---|---|
| 1101378 | | 5/1981 | (CA) . | |
| 289129 | | 12/1915 | (DE) . | |
| 600606 | * | 7/1934 | (DE) | 222/560 |
| 937400 | | 1/1956 | (DE) . | |
| 2525426 A1 | | 12/1976 | (DE) . | |
| 2619990 A1 | | 11/1977 | (DE) . | |
| 3343118 A1 | | 6/1984 | (DE) . | |
| 3510360 A1 | | 11/1985 | (DE) . | |
| 3809548 A1 | | 10/1989 | (DE) . | |
| 2921186 A1 | | 11/1990 | (DE) . | |
| 19522360 | | 8/1996 | (DE) . | |
| 0 736279 A1 | | 10/1996 | (EP) . | |
| 2591201 | | 6/1987 | (FR) . | |
| 2716872 | | 9/1995 | (FR) . | |
| 2725118 | | 4/1996 | (FR) . | |
| 1488372 | | 10/1977 | (GB) . | |
| 2108092 A | | 5/1983 | (GB) . | |
| WO 82/01992 | | 6/1982 | (WO) . | |
| WO 95/00102 | | 1/1995 | (WO) . | |
| WO 96/33128 | | 10/1996 | (WO) . | |

* cited by examiner

*Primary Examiner*—Philippe Derakshani
(74) *Attorney, Agent, or Firm*—Paul M. Ulrich

(57) ABSTRACT

A flow regulator for controlling the flow of material from a container is disclosed, wherein the container includes a container outlet through which the material freely flows when the container outlet is not closed. The flow regulator is biased in a closed position, but is moveable to an open position to provide for material flow from the container. The flow regulator may be progressively moved to permit varying degrees of material flow as the opening in the container is progressively opened. The flow regulator provides both a closure to obstruct material flow and a seal to preserve the container contents from outside contamination or degradation. The flow regulator is disclosed in combination with a bulk bin container to form a novel dispensing mechanism.

1 Claim, 4 Drawing Sheets

U.S. PATENT DOCUMENTS

| | | | |
|---|---|---|---|
| 5,139,173 | 8/1992 | Evinger | 222/185 |
| 5,144,963 | 9/1992 | Dabringhaus et al. | 131/231 |
| 5,219,100 | 6/1993 | Beck et al. | 222/480 |
| 5,284,264 | 2/1994 | Gross | 215/237 |
| 5,328,082 | 7/1994 | Fritz et al. | 229/122.1 |
| 5,385,267 | 1/1995 | Diamond et al. | 221/248 |
| 5,458,295 | 10/1995 | Haber et al. | 241/100 |
| 5,477,981 | 12/1995 | Heyl et al. | 221/86 |
| 5,542,583 | 8/1996 | Bovyer et al. | 222/425 |
| 5,667,108 * | 9/1997 | Braun et al. | 222/560 |
| 5,730,333 | 3/1998 | Baluk et al. | 222/181.3 |
| 5,908,144 | 6/1999 | Dalton | 222/185.1 |
| 5,979,717 | 11/1999 | Dalton et al. | 222/532 |

DISPENSING MECHANISM WITH DUAL FUNCTION FLOW REGULATOR AND SEALING PLATE

FIELD OF THE INVENTION

The invention relates to a flow regulator for controlling the flow of material from a container. The invention also relates to a dispensing mechanism employing a flow regulator for controlling the flow of material from a container.

BACKGROUND OF THE INVENTION

Self serve dispensers have become a common sight in grocery stores throughout the country. These dispensers allow consumers to purchase any quantity of a product by simply retrieving the product from the dispenser in any desired quantity. In this way, consumers are not limited by prepackaged products, manufacturers need not prepackage their goods for purchase by the consumer, and grocery stores are able to stock more product in limited spaces.

These dispensers are generally used for distributing loose bulk items, which the consumer places in a bag or collection device provided adjacent the dispenser. The dispensers have found wide acceptance in the distribution of coffee, grains, candy, rice, beans, nuts, bolts, nails and other products that are easily distributed in loose form.

Among the most common dispensers currently employed in grocery stores is the upright dispenser which relies upon the force of gravity to dispense a product through a nozzle that is selectively opened and closed by a consumer. In use, the consumer generally places a bag beneath a nozzle outlet and opens the nozzle to release the items stored within the container of the dispenser. Once the nozzle is opened, the product freely flows out of the container, through the nozzle and into the bag placed below the nozzle.

One problem with nozzles employed in such dispensers is that they generally rely upon a single barrier to control the flow of product from the container. When these barriers are moved even slightly, the container outlet of the dispenser is opened and product begins to freely flow from container. Even slight movements of the barrier are often enough to cause the product to freely flow, thus product can end up on the floor of the store because the consumer may be unprepared for the immediate product flow. Even when consumers intentionally move the barrier, they often do not expect such slight movement of the barrier to release the free flow of product. When this occurs, the consumer either overfills his or her bag, or inadvertently spills some of the goods flowing from the dispenser.

As such, a need exits for a dispenser capable of distributing loose items, while also providing a substantial amount of control to the consumer gathering the product from the dispenser. The present invention provides a flow regulator and dispensing system which provides such control to consumers.

SUMMARY OF THE INVENTION

The present invention provides a flow regulator for controlling the flow of material from a container, wherein the container includes a container outlet through which the material freely flows when the container outlet is not closed. The flow regulator is biased in a closed position, but is moveable to an open position to provide for material flow from the container. The flow regulator may be progressively moved to permit varying degrees of material flow as the opening in the container is progressively opened. The flow regulator provides both a closure to obstruct material flow and a seal to preserve the container contents from outside contamination or degradation. The flow regulator is disclosed in combination with a bulk bin container to form a novel dispensing mechanism.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
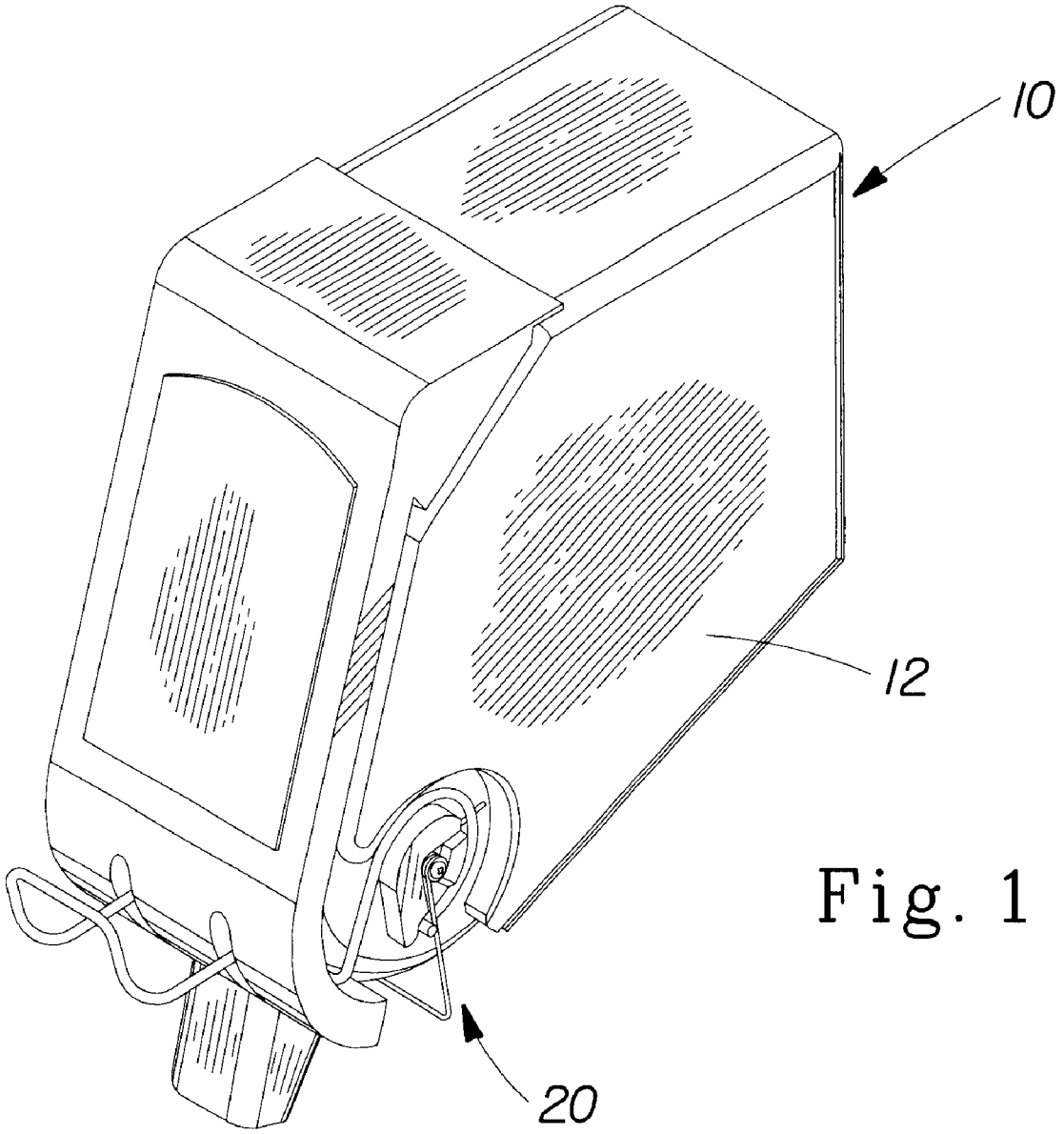
FIG. 1 is a perspective view of the present flow regulator installed in a typical bulk bin.
Figure 5:
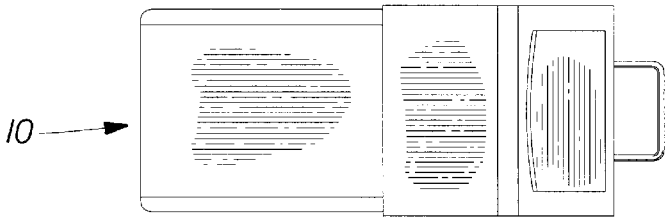
FIG. 5 is a top view thereof.
Figure 2:
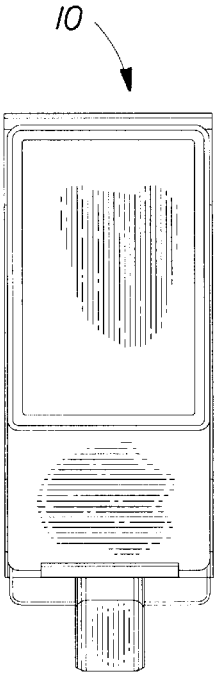
FIG. 2 is a rear elevational view of the bulk bin of FIG. 1.
Figure 3:
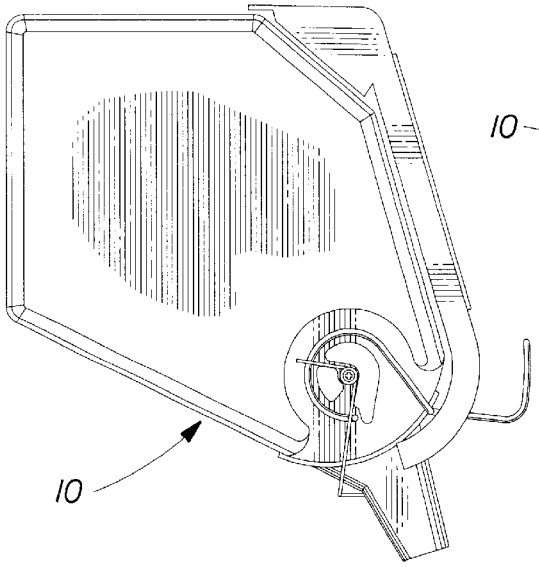
FIG. 3 is a side elevational view of the bulk bin of FIG. 1, the opposite side elevational view being a mirror image thereof.
Figure 4:
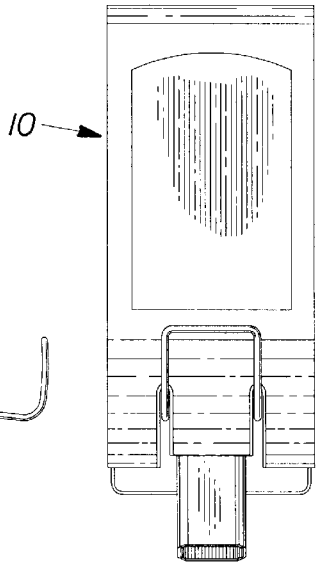
FIG. 4 is a front elevational view thereof.
Figure 6:
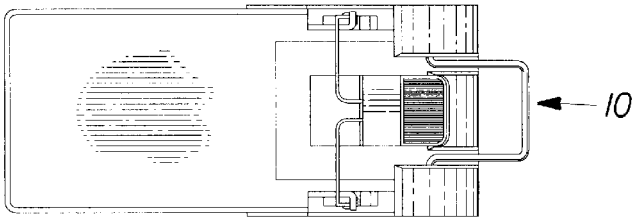
FIG. 6 is a bottom view thereof.
Figure 7:
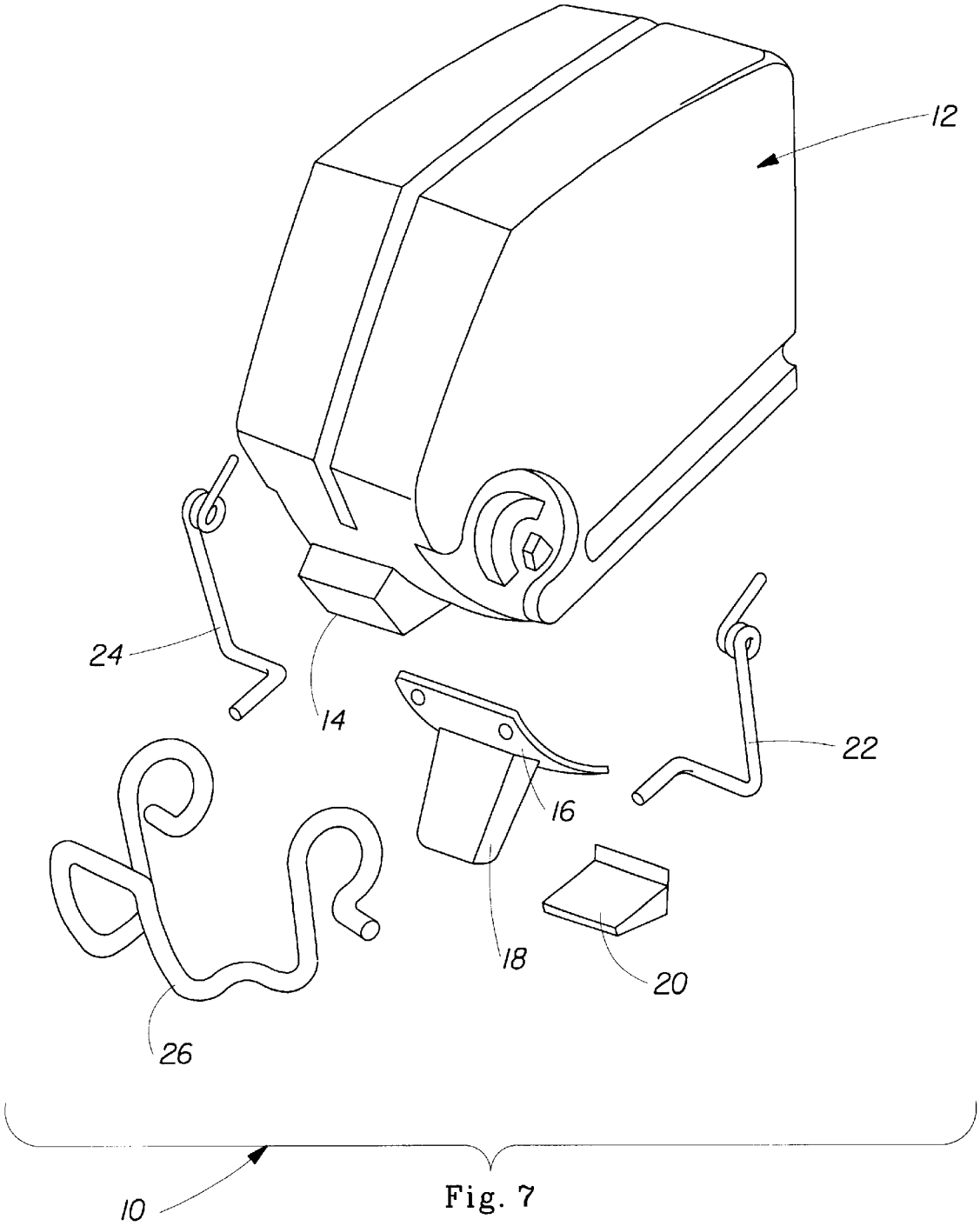
FIG. 7 is an exploded view of the dispensing mechanism and bulk bin of FIG. 1.

FIGS. 1 through 6 disclose a flow regulator and sealing plate 20 as part of a novel dispensing mechanism 10. The mechanism 10 includes a container 12, or bulk bin, having a container outlet 14 though which material passes to a nozzle assembly 18 for dispensing to a consumer. FIG. 7 is an exploded view of the dispensing mechanism 10 of FIGS. 1–6 which depicts the elements of the invention in greater detail.

The nozzle assembly 18 comprises a spout through which the material passes as it is dispensed to the consumer. The nozzle 18 is coupled to the container 12 in conventional fashion. The flow regulator 20 is mounted on two torsion springs 22, 24 which engage the rear of the flow regulator as well as the sides of the container. Suitable bosses or lugs may be formed on the sides of the container to aid in retaining or anchoring the springs. A suitably-shaped handle or lever 26 is also included for use by the consumer in applying a force to the torsion springs to move the flow regulator from the normally-closed position to an open position to allow material to flow from the bin. The configuration of the handle preferably provides increased leverage to aid in overcoming the bias of the flow regulator to the closed position.

Figure 8:
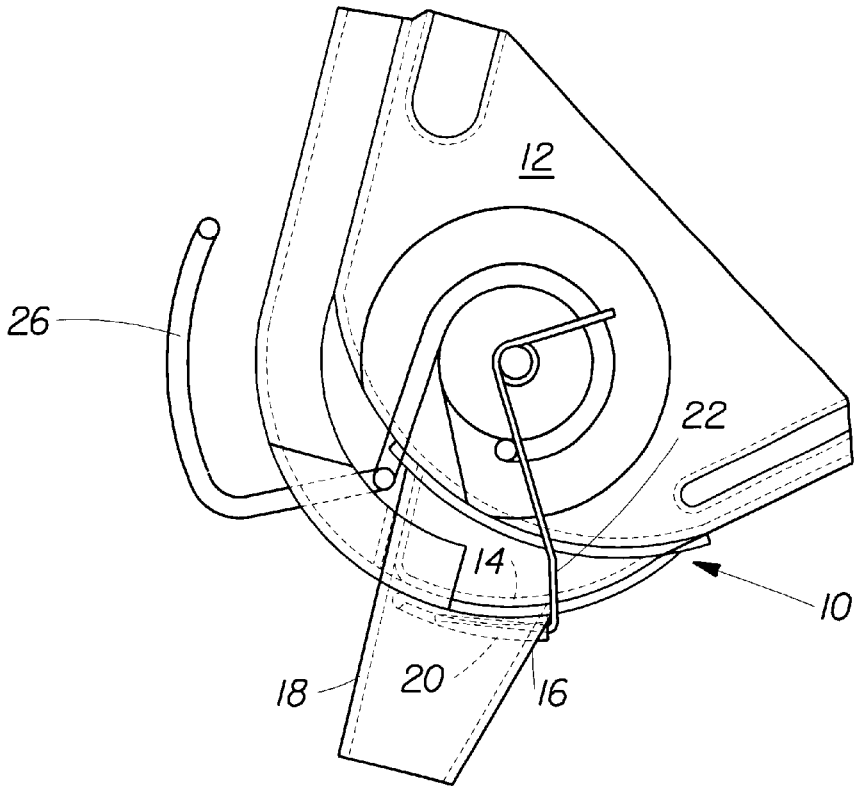
FIGS. 8 and 9 are partial cross sectional views showing the dispensing mechanism as it moves between a closed position and an open position.
Figure 9:
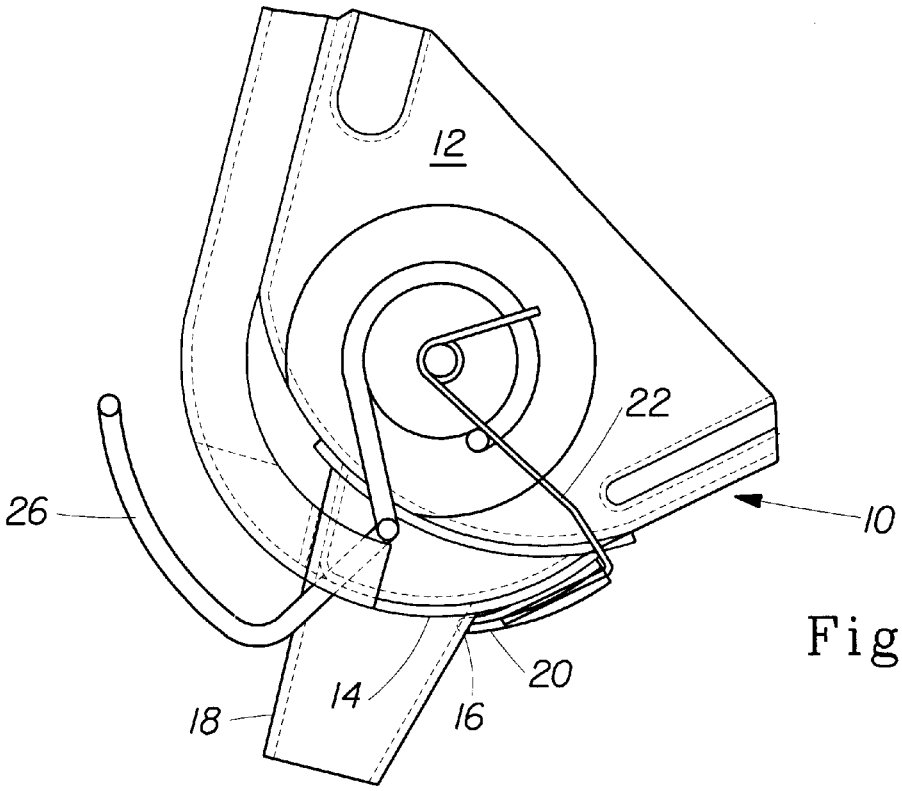

FIGS. 8 and 9 depict the flow regulator in closed and fully open positions, respectively. The flow regulator moves in an arcuate path along the curved outer surface of the bin in the vicinity of the container outlet and preferably slides through a slot 16 in the rear of the nozzle spout, such that the nozzle spout permits translation of the flow regulator over the container opening while the flow regulator is located within the spout and between the container outlet and the spout inlet. In doing so, the flow regulator not only obstructs the container outlet but due to the complementary shapes of the flow regulator and the surface of the bin, also forms an airtight seal to preserve the container contents against contamination and degradation. Sliding movement of the flow regulator along the curved surface of the container is enhanced by ensuring the center of radius on the curved surface of the container is preferably identical to the center of radius of the flow regulator. In this way, smooth arcuate movement of the flow regulator between its first position and its second position is ensured. Progressive opening of the flow regulator provides direct proportional control over the flow rate of material from the container, thus providing enhanced control for the consumer over the dispensing process. While the present invention has been described in the context of an arcuate pathway and curved surfaces, it should be understood that the flow regulator may also be applied to a linear configuration wherein the flow regulator moves translationally along a complementary surface of the container and is likewise biased to a closed position and provides for proportional flow control when in an open position.

Since it is desirable to make certain that the nozzle assembly is only open when a consumer desires to remove material from the container 12, the torsion springs act upon the flow regulator to force the flow regulator to its closed position when a consumer is not applying force to the handle to counter the bias imparted by the springs. When one wishes to stop the flow of material from the container outlet, the applied pressure to the handle is released and the springs force the flow regulator back to its first closed and sealed position.

The container and nozzle may be formed from any suitable material such as a transparent plastic material. Useful materials for the handle and springs include various metals such as spring steel. The flow regulator is preferably formed from a resilient, conformable material such as plastic or rubber.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flow regulator for controlling the flow of material from a container, wherein the container includes a container outlet through which the material freely flows when the container outlet is not closed, comprising:

a material passageway including an inlet, wherein the inlet of the material passageway is fixed relative to the container; and a regulating flap, configured to sealingly engage the container outlet, coupled between the container outlet and the inlet of the material passageway, the regulating flap being moved between a closed and sealed position and an open position where the flow of material from the container outlet is permitted;

wherein movement of the regulating flap relative to the material passageway controls the flow of material from the container and effects a sealing of the container when the flap is in a closed position.

* * * * *